United States Patent [19]

Tuttle

[11] 4,454,696

[45] Jun. 19, 1984

[54] MOTION BEAD FILLER STRIP

[75] Inventor: William I. Tuttle, Warren, Ohio

[73] Assignee: The Bostwick Steel Lath Company, Niles, Ohio

[21] Appl. No.: 502,712

[22] Filed: Jun. 9, 1983

[51] Int. Cl.[3] ..... E04B 2/06

[52] U.S. Cl. ..... 52/346; 52/573; 428/122; 428/124

[58] Field of Search ..... 52/393, 394, 395, 396, 52/573, 346; 404/64, 65, 68; 428/121, 122, 124

[56] References Cited

U.S. PATENT DOCUMENTS 3,440,934 4/1969 Dill ..... 52/396 X
3,888,599 6/1975 Reifsnyder ..... 52/396 X

FOREIGN PATENT DOCUMENTS 636804 2/1962 Canada ..... 52/396
2328819 3/1975 Fed. Rep. of Germany ..... 52/396

*Primary Examiner*—Henry F. Epstein
*Attorney, Agent, or Firm*—Harpman & Harpman

[57] ABSTRACT

A motion bead filler strip for application to the spaced flanged edges of expanded steel lath used in plaster finished walls flexibly seals expansion joints in such walls. The filler strip is an elongated cross sectionally inverted V-shaped outwardly flanged member formed of a flexible synthetic resin, the flanges being inturned toward the V-shape and provided with longitudinally extending ribs on their outermost surfaces. The inturned portions of the flanges define continuous pockets registrable over inturned flanges on the longitudinal edges of conventional expanded steel lath.

7 Claims, 3 Drawing Figures

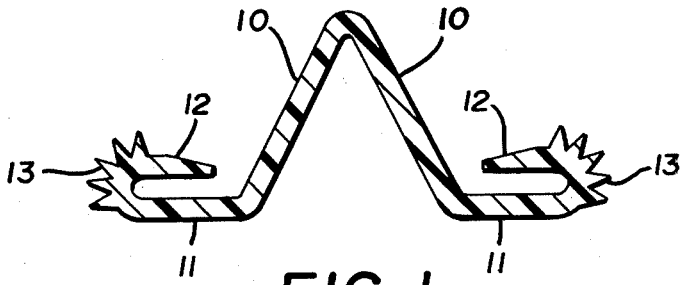
FIG. 1
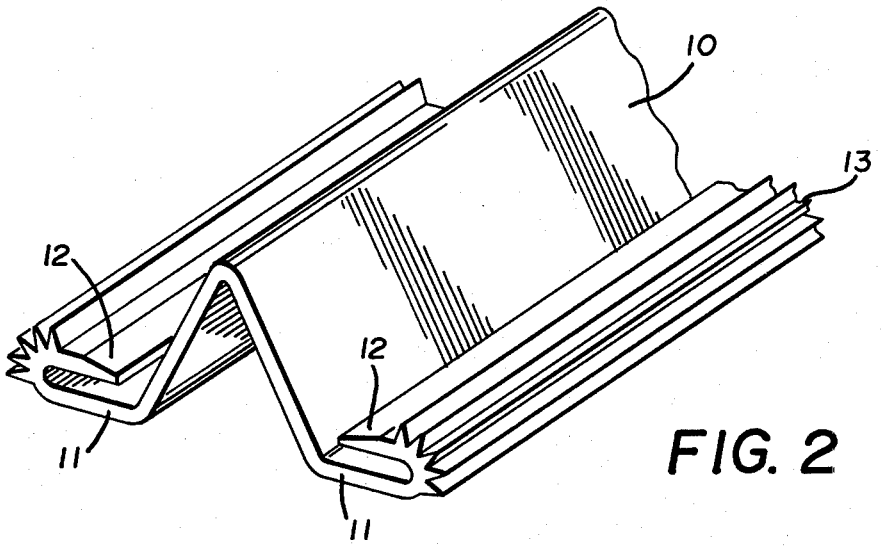
FIG. 2
FIG. 3
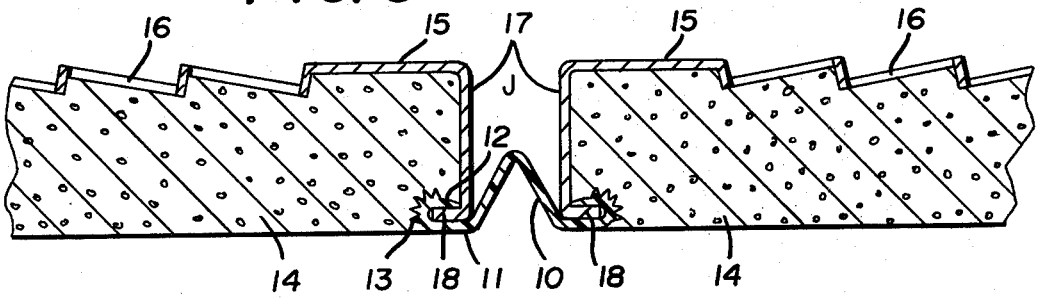

MOTION BEAD FILLER STRIP

BACKGROUND OF THE INVENTION

1. Technical Field

This invention relates to plaster finished walls supported on expanded steel lath and provided with expansion joints usually vertically disposed and more particularly to means for flexibly sealing such expansion joints.

2. Description of the Prior Art

No prior art devices are known that provide a flexible sealing connection between the flanged edges of expanded steel lath used as the supporting structure of a plastered wall, the flanged edges of the expanded steel lath being spaced with respect to one another to form an expansion joint in the finished wall.

SUMMARY OF THE INVENTION

A motion bead filler strip takes the form of a continuous cross sectionally inverted V-shaped plastic extrusion having outurned flanges, the longitudinal edges of which are doubled back to form inturned flanges closely spaced with respect to the outturned flanges and terminating in spaced relation to the inverted V-shape of the central portion of the motion bead filler strip. The spaces between the outturned and inturned flanges define longitudinally extending pockets in the flexible plastic extrusion enabling the motion bead filler strip to be quickly and easily installed on the flanged edges of spaced expanded steel lath to form a flexible distortable resilient seal in an expansion joint defined thereby.

DESCRIPTION OF THE DRAWINGS

FIG. 1 is an enlarged cross sectional elevation of the motion bead filler strip;

FIG. 2 is an enlarged perspective elevation of a portion of the motion bead filler strip; and FIG. 3 is an enlarged cross section through a plastered wall having an expansion joint therein and the device of the invention in position flexibly sealing the expansion joint.

DESCRIPTION OF THE PREFERRED EMBODIMENT

By referring to the drawings and FIGS. 1 and 2 in particular, it will be seen that a substantially enlarged representation of the motion bead filler strip comprising the invention has been illustrated.

The device comprises an inverted V-shaped longitudinally extending flexible plastic shape, the inverted V-shaped portion formed of joined angular sections 10 having outwardly extending flanges 11 integral therewith said flanges 11 having inturned portions 12 terminating in spaced relation to the angular sections 10 of the filler strip.

A plurality of longitudinally extending ribs 13, five are preferably utilized, are formed on the outer longitudinal portions of the outturned flanges 11 where they curve upwardly and inwardly to form the inturned portions 12. The space between the outturned flanges 11 and the inturned portions 12 is such that it will resiliently engage inturned flanges on the longitudinal edges of expanded steel lath as best shown in FIG. 3 of the drawings.

In FIG. 3 of the drawings, which is, for example a horizontal section through a portion of a plastered wall, the plaster is indicated at 14 and illustrated as being engaged on sections of expanded steel lath 15, the expanded sections thereof defining openings 16 in which the plaster 14 is engaged as will be understood by those skilled in the art. The expanded steel lath is formed in sheet-like sections having right angular flanges 17 on its appropriate edges, the right angular flanges 17 being inturned as at 18 with the flanges 17 of the expanded steel lath being spaced to form an expansion joint J.

In FIG. 3 of the drawings, the motion bead filler strip is shown with the longitudinal resilient pockets thereof that are formed by the spaced flanges 11 and inturned portions 12 engaged on the inturned flanges 18 of the expanded steel lath 15.

In an actual wall construction, such as described, and in which the motion bead filler strip is attached to the inturned flanges 18 of the expanded steel lath 15, the width of the expansion joint is approximately one-quarter inch and the overall height of the inverted V-shaped center section of the filler strip formed of the joined angular sections 10 is approximately three-eights of an inch and the overall width of the filler strip from the ribs 13 on one side to the ribs 13 on the other is approximately three-quarters of an inch.

Those skilled in the art will appreciate that the motion bead filler strip of the invention functions satisfactorily in plastered wall constructions based on expanded steel lath regardless of the actual width of the expansion joints provided. The motion bead filler strip as disclosed herein is preferably made of a flexible suitably colored synthetic resin such as polyvinyl chloride and may be inexpensively extruded in continuous lengths and so delivered to the job site. When the expanded steel lath 15 is installed on the usual supports, such as steel studding, the desired expansion joint width is determined and fixed whereupon the motion bead filler strip is quickly and easily applied to the oppositely disposed inturned flanges 18 of the expanded steel lath where its configuration resiliently and frictionally engages the same and thus insures its retention in desirable position with the joined angular sections 10 disposed in the actual expansion joint.

The application of plaster as shown at 14 of FIG. 3 of the drawings, additionally secures the motion bead filler strip as the plaster in its soft applied state engages the spaces between the longitudinally extending ribs 13 and between the ribs 13 and the inner surfaces of the flanges 17 of the expanded steel lath 15 and very advantageously forms a desirable configuration against which the trowel used in applying the plaster slidably engages as the plaster 14 is installed.

The flexible polyvinyl chloride used in forming the motion bead filler strip is preferably provided with white pigmentation so that the edges of the filler strip and the joined angular sections 10, which remain visible after the plaster is applied, match the white plaster and form an attractive expansion joint, which remains flexible during expansion and contraction of the adjacent wall sections it joins, and at the same time seals the expansion joint to prevent air flow and dust or other foreign material from passing through the expansion joint as has frequently been the case in prior art constructions.

It will thus be seen that a simple, inexpensive, easily applied motion bead filler strip for expansion joints defined by the flanged edges of expanded steel lath has been disclosed, and having thus described my invention,

What I claim is:

1. A motion bead filler strip for installation in an expansion joint formed by spaced expanded steel lath having inturned flanged edges, said filler strip including an elongated flexible central section formed of joined angular sections, integral continuous oppositely disposed flanges extending outwardly along each edge of said flexible central section on a common plane, the longitudinal edges of said continuous flanges being doubled back thereover so as to define flexible longitudinally extending pockets between said continuous flanges and said doubled back edges thereof for resiliently and flexibly engaging the inturned flanged edges of said expanded steel lath.

2. The motion bead filler strip set forth in claim 1 and wherein longitudinally extending ribs are formed on the portions of the longitudinally extending flanges where the same are doubled back to form the longitudinally extending pockets.

3. The motion bead filler strip set forth in claim 1 and wherein the flexible central section is of a height at least one-half the width of the filler strip including said flanges.

4. The motion bead filler strip set forth in claim 1 and wherein the plastic extrusion comprises polyvinyl chloride and a white pigment coloring agent.

5. The motion bead filler strip set forth in claim 1 and wherein said flexible center section is formed in an inverted V-shape.

6. The motion bead filler strip set forth in claim 1 and wherein said flexible center section is formed in an inverted U-shape.

7. The combination in a wall structure of spaced flanged expanded steel lath and a filler strip disposed therebetween to form an expansion joint in said wall structure, said expanded steel lath having flanged inturned edges and said filler strip having a central flexible section formed of joined angular sections arranged to partially fill said expansion joint, oppositely disposed outturned flanges on said central section and inwardly facing pockets formed in said flanges, and ribs on said flanges arranged in oppositely disposed relation to said pockets, said pockets continuously frictionally engaged on said inturned edges of said flanged expanded steel lath.

* * * * *